US005365697A

United States Patent [19]

Vanderpan

[11] Patent Number: 5,365,697

[45] Date of Patent: Nov. 22, 1994

[54] DOOR FRAMING DEVICE FOR PRE-HUNG DOOR ASSEMBLIES AND METHOD

[76] Inventor: Ronald E. Vanderpan, 1430 Glenmoor Way, San Jose, Calif. 95129

[21] Appl. No.: 892,022

[22] Filed: Jun. 2, 1992

[51] Int. Cl.[5] ..... E06B 1/00

[52] U.S. Cl. ..... 49/380; 49/371; 52/213

[58] Field of Search ..... 52/212, 213, 214, 204, 52/290, 215, 216, 217, 127.2; 49/380, 371

[56] References Cited

U.S. PATENT DOCUMENTS

| | | | |
|---|---|---|---|
| 3,593,458 | 7/1971 | Wahifeld et al. | 49/380 |
| 3,618,261 | 11/1971 | Torbett | 49/380 |
| 4,483,101 | 11/1984 | Berzina | 49/380 |
| 4,718,195 | 1/1988 | Ortega | 49/380 |
| 5,209,017 | 5/1993 | Ridge | 49/380 |

*Primary Examiner*—Carl D. Friedman
*Assistant Examiner*—Winnie Yip
*Attorney, Agent, or Firm*—Flehr, Hohbach, Test, Albritton & Herbert

[57] ABSTRACT

A door framing spacer apparatus (41, 41*a*) and method for use with a pre-hung door (21, 21*a*) to enable installation of the door in a door opening (31). The spacer assembly (41, 41*a*) is formed for positioning between the door (21) and a door jamb member (27) or the door (21) and another door (21*a*). The portion of the spacer (41, 41*a*) between the door (21) and jamb member (27) has a thickness dimension (t) therebetween substantially equal to a desired reveal space (29) to be maintained between the door (21) and jamb (27). The spacer (41, 41*a*) can include a door portion (46, 46*a*) which is secured by a fastener (43, 43*a*) to the door and a jamb portion (47, 47*a*) which is secured by a fastener (42, 42*a*) to the jamb. The spacer additionally includes a connecting portion (48) between the door and jamb portions which couples the two together as a unit and in turn couples the door (21) to the jamb assembly (23) to enable manipulation of the assembly during installation. Once the door (21) and jamb assembly (23) are installed, the connecting portion (48) of the spacer (41, 41*a*) can be severed to release and permit opening of the door and removal of the spacer assemblies.

20 Claims, 6 Drawing Sheets

DOOR FRAMING DEVICE FOR PRE-HUNG DOOR ASSEMBLIES AND METHOD

TECHNICAL FIELD

The present invention relates, in general, to apparatus and methods for mounting of hinged members, such as doors, and more particularly, relates to apparatus and methods for the mounting of a pre-hung door and door jamb assembly in a door opening.

BACKGROUND ART

At the present time a very high percentage of all of the residential doors which are installed, for example, more than 70 percent and possibly as high as 90 percent, are supplied to builders as pre-hung door and jamb assemblies. Thus, the door is already mounted or hung in the jamb assembly at the factory by hinge means to one of the jamb members. The other side of the door will be formed with a lockset and knob opening and the jamb member will have a latch or striker plate opening.

Typically, pre-hung door and jamb assemblies are shipped to the installation site from the factory with the jamb member opposite the door hinges either fastened directly to the edge of the door or spaced from the door edge by a plurality of shipping stabilizers. Sometimes the shipping stabilizers are merely thin pieces of wood, paper or cardboard that is nailed or adhesively secured between the door and jamb and held in place by strapping.

In other instances, L-shaped stabilizing brackets have been provided which are bolted into the edge of the door and the front of the jamb. This stabilizing bracket and bolt system, for example, is more commonly used on commercial metal pre-hung doors by manufacturers such as Stanley Tools.

In most cases, when the door is received at the installation site, the jamb member opposite the hinges is freed or unfastened. The stabilizer members are usually left in place, if they are the cardboard variety, or removed, if they are metal L-shaped brackets. There would be no practical way to remove the metal bracket stabilizers if the doors were installed with them in place. While the door is hinged to one side of the jamb assembly, removal of the spacers and/or unbinding of the assembly frees the opposite door jamb member to move relative to the door. The door assembly installer must position the door in the door opening, do the necessary shimming between the door opening and the jamb members so as to mount the door assembly in a squared-up relationship inside the door opening. Moreover, the stabilizers are usually thinner than the desired reveal space between the door and jamb, so the installers manipulate the jamb to produce the desired reveal space, usually establishing the reveal space by eye. During this process, two installers are often employed, particularly to control the free or lockset side of the door. Using conventional installing techniques approximately 20 to 30 minutes will be required to install a pre-hung door. This is a significant time savings over doors which are not pre-hung, but it still represents a significant amount of time, particularly when two installers are employed.

French or double doors are even more difficult to install. While they are hinged at the opposed jamb members, the doors at the center will be free to move, once the assembly is unpacked and the shipping fasteners and stabilizers are removed. Moreover, since the bottoms of the jamb members are not connected, they are free to diverge, making plumbing of the door in the door opening a difficult and time-consuming job.

The difficulties in connection with manipulating pre-hung door assemblies can compromise the quality of the installation. Installers with less experience and patience will install pre-hung doors in varying degrees of skew, particularly when the door openings are roughly constructed, which is almost always the case.

DISCLOSURE OF INVENTION

Accordingly, it is an object of the present invention to provide a door framing device and method which is suitable for use for installing pre-hung door and jamb assemblies to greatly aid in the manipulation of these assemblies during installation.

A further object of the present invention is to provide a spacer device which can be used with pre-hung doors to secure the doors to the jamb, or another door, can be left in place during installation, and easily removed after installation.

Still another object of the present invention is to provide a door framing device and method which is easy and inexpensive to construct, can be used by relatively unskilled personnel, effects a substantial savings in door assembly installation costs, is suitable for use with single and double doors, and produces a spacing of the door relative to the jamb assembly equal to the desired reveal space.

The door framing device of the present invention may be used to space a pre-hung door mounted by hinged means to a jamb assembly during installation of the door and jamb assembly in a door opening. The framing device of the present invention comprises, briefly, a spacer formed for positioning between the door and one of another door and the jamb assembly. The spacer has a thickness dimension substantially equal to a desired reveal space to be maintained between the door and the jamb assembly, and fasteners are provided for fastening the spacer to both the door and the jamb assembly (or another door). Finally, the spacer is formed to secure the door to the jamb assembly (or other door) and is formed to enable opening of the door after installation to allow removal of the spacer. In the preferred form, the spacer is formed with a door portion which is secured to the door by a fastener, a jamb portion secured to the jamb by a fastener and a connecting portion connecting the door portion and the jamb portion. The connecting portion of the spacer is severable, for example, by cutting, so as to free the door portion from the jamb portion and permit opening of the door after installation in the door opening for removal of the spacer.

In another aspect of the present invention, a method of installing a pre-hung door assembly in a door opening is provided and is comprised, briefly, of the steps of positioning a combination door and jamb assembly in a door opening with a spacer mounted therebetween having a thickness dimension equal to a desired reveal space between the door and jamb assembly. The spacer is secured to both the door and jamb assembly to couple the same together as a unit for handling during the positioning step. The method further includes the steps of securing the combination door and jamb assembly in the door opening and, thereafter, from one side of the installed door and jamb assembly, releasing the spacer for opening of the door, preferably by severing a connecting portion of the spacer.

BEST MODE OF CARRYING OUT THE INVENTION

The framing apparatus and method of the present invention are described in connection with their use in the installation of pre-hung doors. It will be understood, however, that the present spacer assembly and method may have other applications in connection with hinge-mounted partitions and the like.

Figure 1:
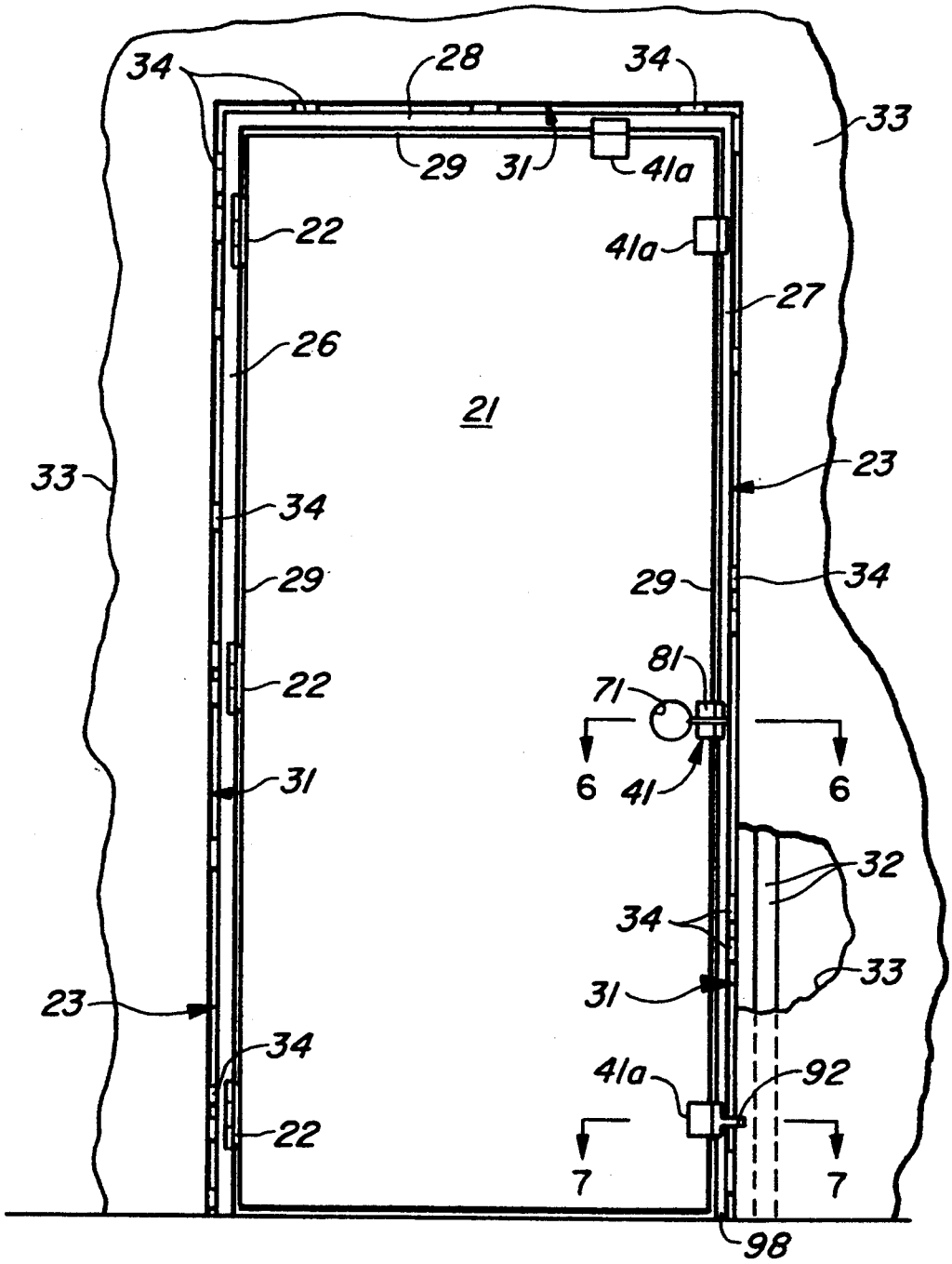
FIG. 1 is a front elevation view, partially broken away, of a door assembly installed in a door opening using the door framing device and method of the present invention.

Referring now to FIG. 1 a door, generally designated 21, can be seen to be mounted by hinges 22 to a door jamb assembly, generally designated 23. Jamb assembly 23 includes a first vertical door jamb member 26, to which hinges 22 couple door 21, a second vertically extending door jamb member 27 and a transversely extending jamb rail member 28. As will be seen in FIG. 1, there will be a small space 29 between door 21 and jamb assembly members 26, 27 and 28, which space is referred to as the "reveal" space. The desired reveal space on most residential doors is approximately 0.100 inches, although smaller or larger reveal spaces are also used.

Door 21 and jamb assembly 23 are shown installed in a rough door opening 31, which is usually defined by structural framing members, such as 2×4 studs 32 to which a wall surface, such as sheetrock 33, may be mounted. Positioned between framing members 32 and jamb assembly 23 are a plurality of shims 34 which are used to true-up or plumb the door and jamb assembly in opening 31. Once the jamb assembly and door are shimmed into a plumb position in opening 31, the jamb members 26, 27 and 28 will be secured by fasteners, usually nails, to framing members 32 to hold door 21 squarely in place in opening 31. As thus far described, the door, jamb assembly and structure defining the door opening are all well known in the art and do not comprise a portion of the present invention.

Figure 1A:
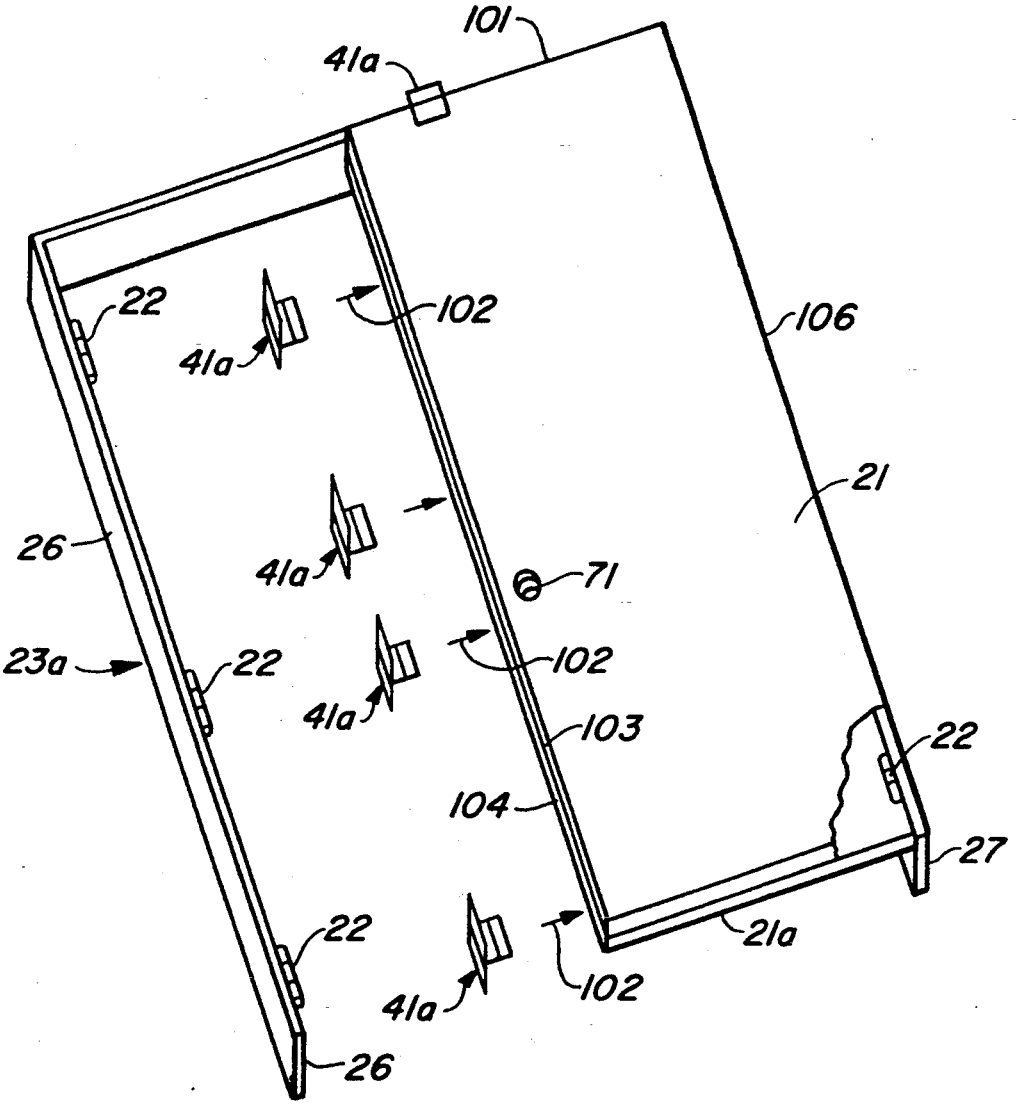
FIG. 1A is a top perspective view of a double door assembly supported on a horizontal surface during installation of the spacers constructed in accordance with the present invention.
Figure 2:
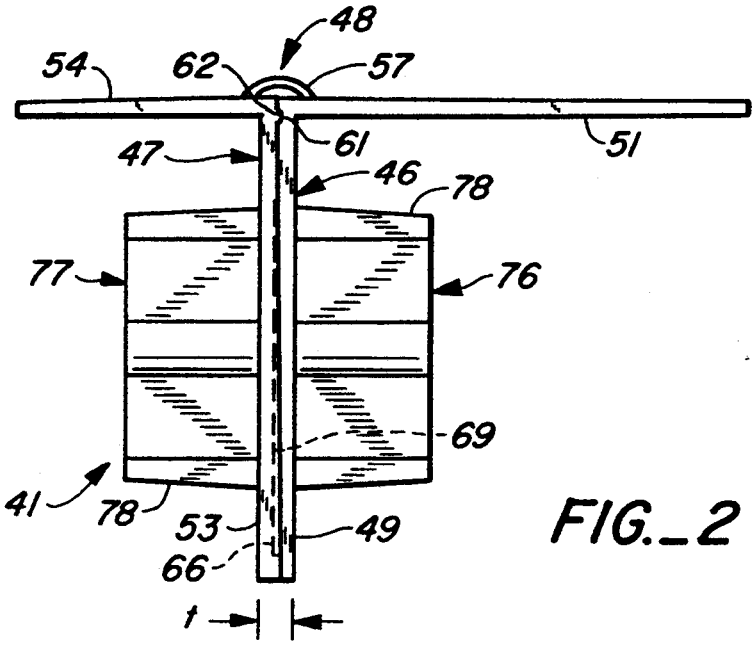
FIG. 2 is a top plan view of a spacer assembly constructed in accordance with the present invention.
Figure 3:
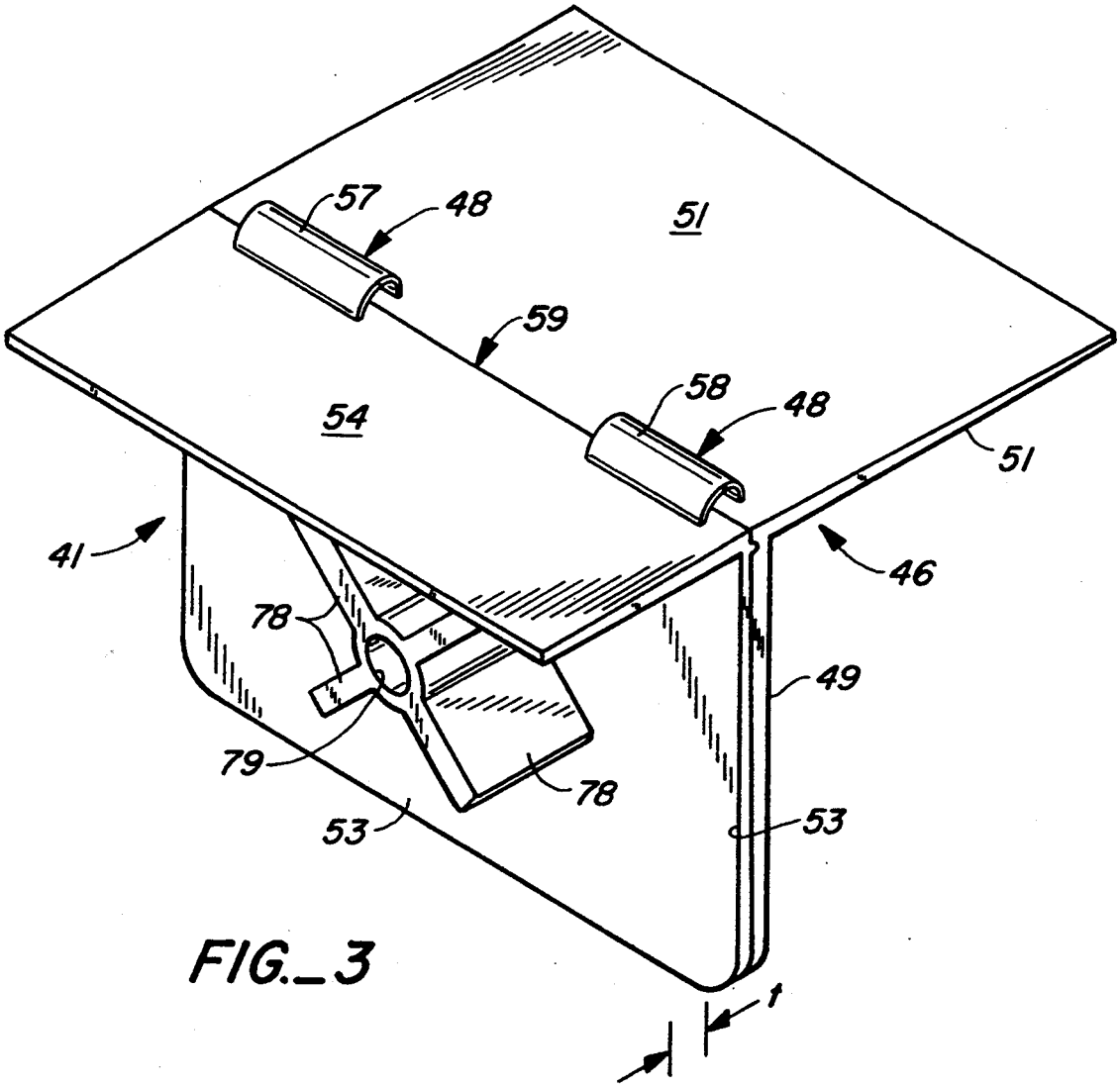
FIG. 3 is a top perspective view of the spacer assembly of FIG. 2.

In order to greatly facilitate installation of pre-hung door 21 and jamb assembly 23, a door framing device is provided in the form of a spacer means, generally designated 41, and best seen in FIGS. 2 and 3. Spacer means 41 is formed for positioning of a portion thereof between door 21 and jamb assembly 23. The same spacer means 41 can also be used in connection with pre-hung double-doors, by mounting the spacer between a first door 21 and a second door 21*a*, as best may be seen in FIG. 1A. The positioning of spacer 41 between two doors will be described in greater detail hereinafter, but the construction of spacer 41 will first be described in connection with mounting of a single door within a jamb assembly, as shown in FIG. 1.

Spacer means 41 is formed with a thickness dimension, t, in the portion positioned between the door and jamb (or between two doors) which is substantially equal to the desired reveal space between door 21 and jamb assembly 23 once the door is installed. Thus, in most cases, the thickness, t, of the spacer 41 will be one the order of about 0.100 inches. Installation of spacer means 41 between the door and jamb can be seen in FIG. 6, as can thickness dimension, t. It will be noted that spacer 41 has been rotated by 180 degrees as installed in FIG. 6, as compared to FIG. 2.

Figure 6:
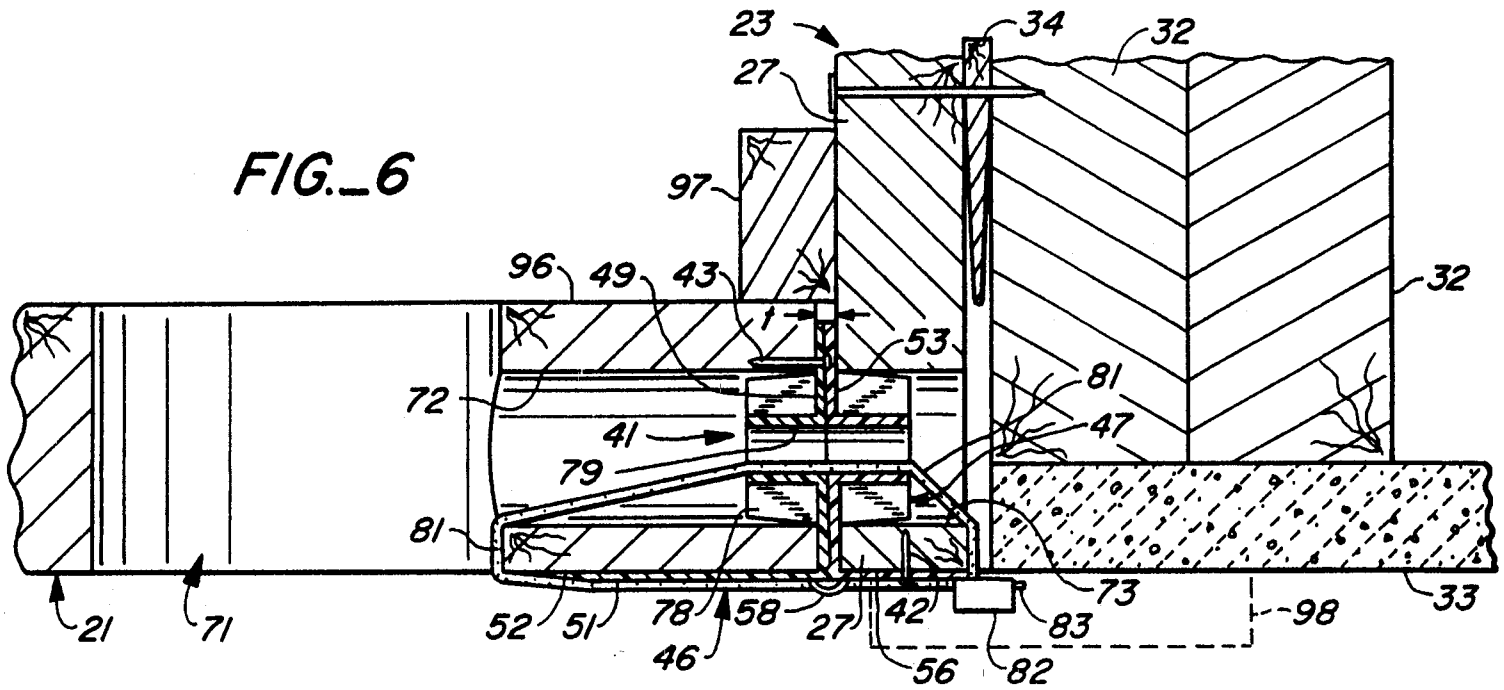
FIG. 6 is a fragmentary, cross-sectional view taken substantially along the plane of line 6—6 in FIG. 1.
Figure 7:
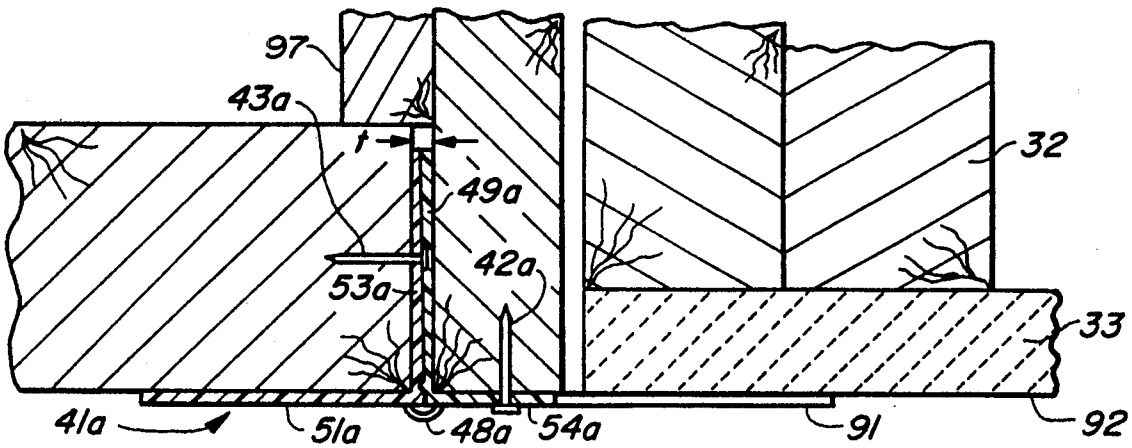
FIG. 7 is a fragmentary, cross-sectional view taken substantially along the plane of line 7—7 in FIG. 1.

The door framing device of the present invention further includes fastener means, such as staples 42 and 43 in FIG. 6, or nails 42*a* and 43*a* in FIG. 7, which fasten the spacer to both door 21 and jamb assembly 23, or to second door 21*a* an a double door installation.

In order to allow the door and jamb assembly to be handled as a unit in a manner similar to pre-hung window assemblies, spacer 41 further acts as a separable connector between door 21 and jamb assembly 23 during installation. Moreover, and very importantly, spacer 41 is formed to enable easy opening of the door after installation of the door and jamb for removal of the spacer. This separable coupling together of the door and jamb is preferably accomplished by forming spacer 41 with a door portion 46, a jamb portion 47, and a connecting portion 48 coupling the door portion to the jamb portion of the spacer.

As can be seen from FIGS. 2 and 3, door portion 46 can advantageously be provided by an L-shaped door element having one leg 49 which extends between the door and jamb and another leg 51 extending along a front surface 52 of door 21. Similarly, jamb portion 47 may advantageously be provided as an L-shaped jamb element having one leg 53 extending between the door and the jamb and a second leg 54 extending transversely along front surface 56 of jamb member 27. As will be seen, therefore, from FIGS. 2, 3 and 6, the combined thickness of legs 49 and 53 of the door element and jamb element should equal the desired reveal space thickness, t.

In order to facilitate release of the coupled together door element and jamb element, it is preferable to provide connecting portion 48 as means which can be parted, severed or separated, for example, a pair of hinges 57 and 58. Hinges 57 and 58 are joined and extend between door element leg 51 and jamb element leg 54. As can be seen in FIG. 6, hinges 57 and 58 stick outwardly from spacer 41 on a front side of the door. It is a simple matter, therefore, to use a knife to cut hinges 57 and 58 along the interface or seam 59 between opposed door element leg 51 and jamb element leg 54. In order to facilitate severing or cutting of hinges 57 and 58, it is preferable that spacer 41 be formed of a plastic material, such as polyethylene, Nylon or a similar easily injection molded plastic. The hinge structure also permits molding of spacer 41, in a manner which we described in more detail in connection with FIGS. 4 and 5.

Alternative means which can be used to couple door element 46 and jamb element 47 together might include providing a tear strip or perforated connection proximate seam 59, a snap-acting coupling or an embedded tear wire.

In order to facilitate opening of door 21 after severing of hinges 57 and 58, leg 49 of door element 46 preferably has a thickness dimension which decreases in a direction away from leg 51 of the door element. Conversely, jamb element leg 53 preferably has a thickness dimension which increases in a direction away from jamb element leg 54 so as to support the door and jamb in spaced relation over the full door thickness. As will be appreciated, this mating tapering of legs 49 and 53 enables door 21 and leg 49 to swing passed the outermost edge of leg 53 of the jamb element.

Figure 3A:
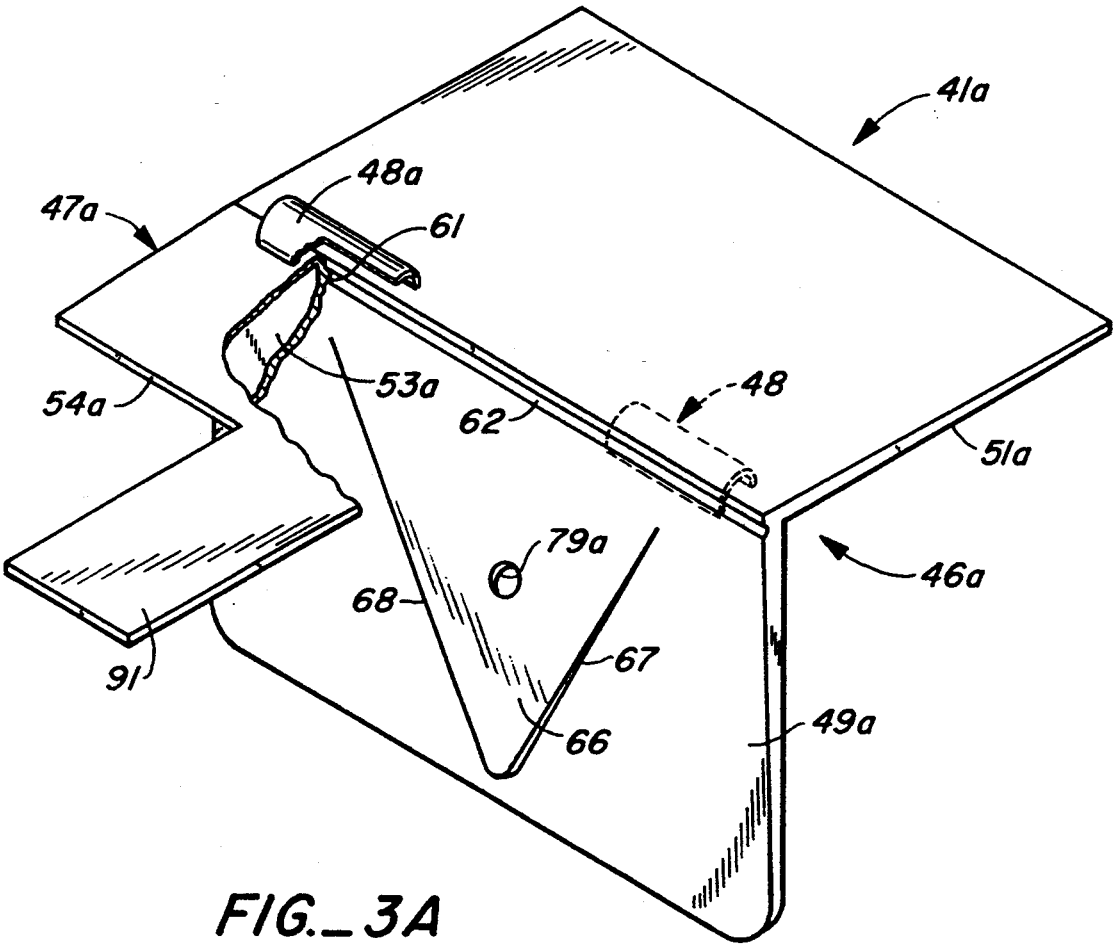
FIG. 3A is a top perspective view, corresponding to FIG. 3, and partially broken away of the spacer assembly of FIG. 2A.

Moreover, in order to provide a temporary detent which will hold the door in a closed position relative to the jamb, and further in order to provide alignment of the door element and jamb element, a protrusion 61 and mating recess 62 may be provided proximate hinge means 48. As shown in the drawing, protrusion 61 is formed in the outermost edge of jamb element leg 53, while mating recess 62 is proximate the outermost edge of door element leg 49. Groove 62 also may be seen (FIG. 3A) to extend over the height of the spacer, as preferably also is the case for protrusion 61.

A further feature of spacer 41 of the present invention is that it may be formed with mating vertical registration surfaces. As best may be seen in FIG. 3A, door element leg 49 can have formed therein a gradually outwardly projecting protrusion 66 having V-shaped side edges 67 and 68. A mating V-shaped recess 69 is provided in jamb element leg 53. When protrusion 66 is mated with recess 69, the registration of surfaces 67 and 68 prevents vertical shifting of the door element relative to the jamb element. The registering protrusion 66 and recess 69 prevent the door from slipping or sagging downwardly relative to the jamb.

Spacer 41 is constructed to enable the same to be positioned at the door knob and lockset opening. As can be seen in FIGS. 1 and 6, door 21 can be formed with a knob opening 71 with a lockset bore 72 which extends from knob opening 71 to the edge of the door. A similar latch plate or striker plate bore 73 is provided in jamb member 27 in longitudinal alignment with the lockset bore 72. Such construction is conventional in pre-hung door assemblies. When double doors are employed, both of the doors may have a knob hole bore 71 and transversely extending lockset and latch bores.

Spacer means 41, therefore, may be provided with lockset opening registration means 76 on door element 46 and a similar registration means 77 on jamb element 47. These lockset opening registration means extend outwardly from legs 49 and 53 and preferably include radially extending vane means 78 (FIG. 3) formed for engagement with the door and jamb defining the lockset bores. Passageway means 79, best seen in FIG. 6, extends through the lockset opening registration means 76 and 77 and allows a tie means, such as strap 81 to tie the assembly positively together against the spacer as a unit. Tie means 81 can include a one-way cinching means 82 through which strap end 83 is inserted and pulled down until the strap is tight. The excess of strap beyond one-way cinching means 82 may be cut off. As will be appreciated, passageway 79 is located about midway between hinges 57 and 58, which permits strap 81 to pass between the hinges along the front side of the spacer. It is further desirable and an advantage of the present invention to form the strap of a plastic material which also can be severed by a knife by reaching into knob opening 71 from either side of the door and cutting the strap or by running a knife along seam 59 between the door element and jamb element. As will be seen from FIG. 2, vanes 78 can be slightly tapered to accommodate lockset bores of various diameters, and can be bent over or trimmed for smaller diameter door lockset bores 72 and 73.

Figure 2A:
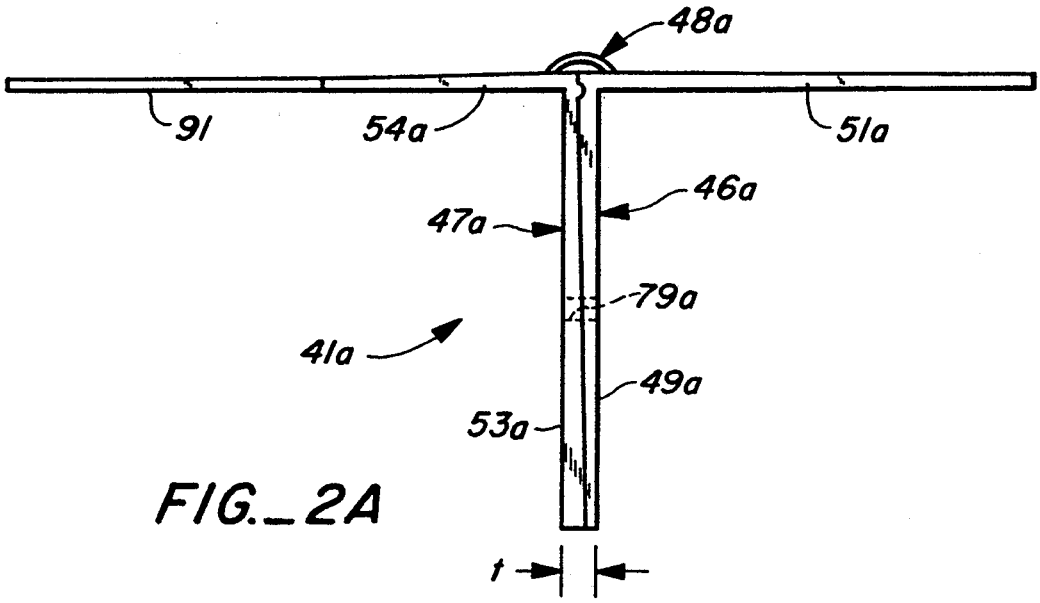
FIG. 2A is a top plan view of an alternative embodiment of the spacer assembly of FIG. 2.

Spacer 41, with its lockset registration means, is not suited for use at locations which do not have lockset bores or openings. Accordingly, a similarly formed spacer, without the lockset registration means, can be employed for spacers at other locations. Spacer 41*a* is constructed without lockset registration means, as shown in FIG. 2A. Thus, the inwardly extending legs 49*a* and 53*a* are planar on the door and jamb engaging surfaces and have a combined thickness substantially equal to the desired reveal thickness, t. The legs 51*a* and 54*a* are constructed in a manner similar to the corresponding legs in spacer 41, and the door element 46*a* is connected to jamb element 47*a* by hinge means 48*a*. Spacer 41*a* also can be used in a lockset position by providing a passageway 79*a* through legs 49*a* and 53*a* for passage of a strap or tie therethrough. The installation of spacer means 41*a* is shown in FIG. 7.

As a further aid to installation of the door and jamb assembly, leg 54*a* on jamb portion of the spacer assembly can be provided with a tab 91 which extends outwardly, as shown in FIG. 7, to a position flush with the front surface 92 of sheetrock member 33. Tab 91, therefore, assists the installer in positioning and securing the door and jamb assembly flush with the front surface 92 of the wall. As will be appreciated, both lockset spacers 41 and non-lockset spacers 41*a* may include alignment tabs 91.

Figure 4:
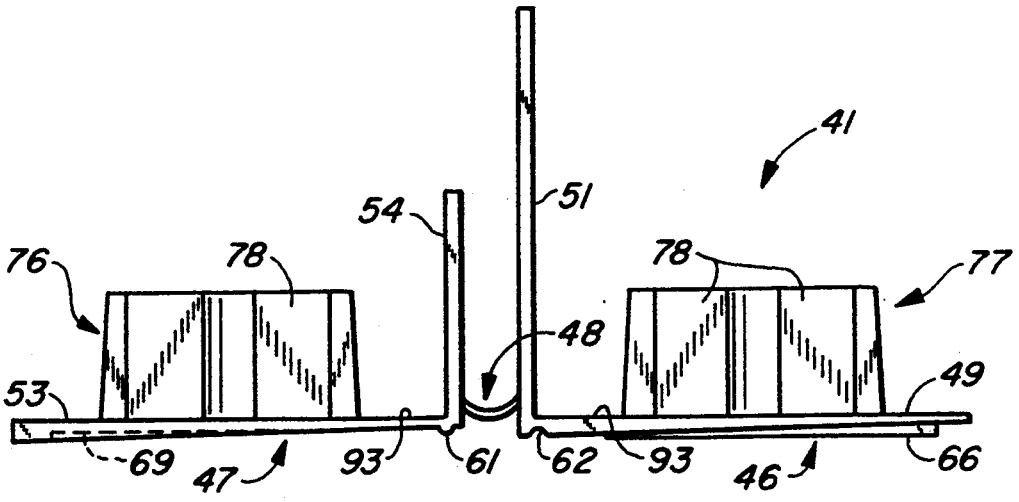
FIG. 4 is a top plan view of a further alternative embodiment of the spacer of FIG. 2, with the spacer legs rotated by 90 degrees.
Figure 5:
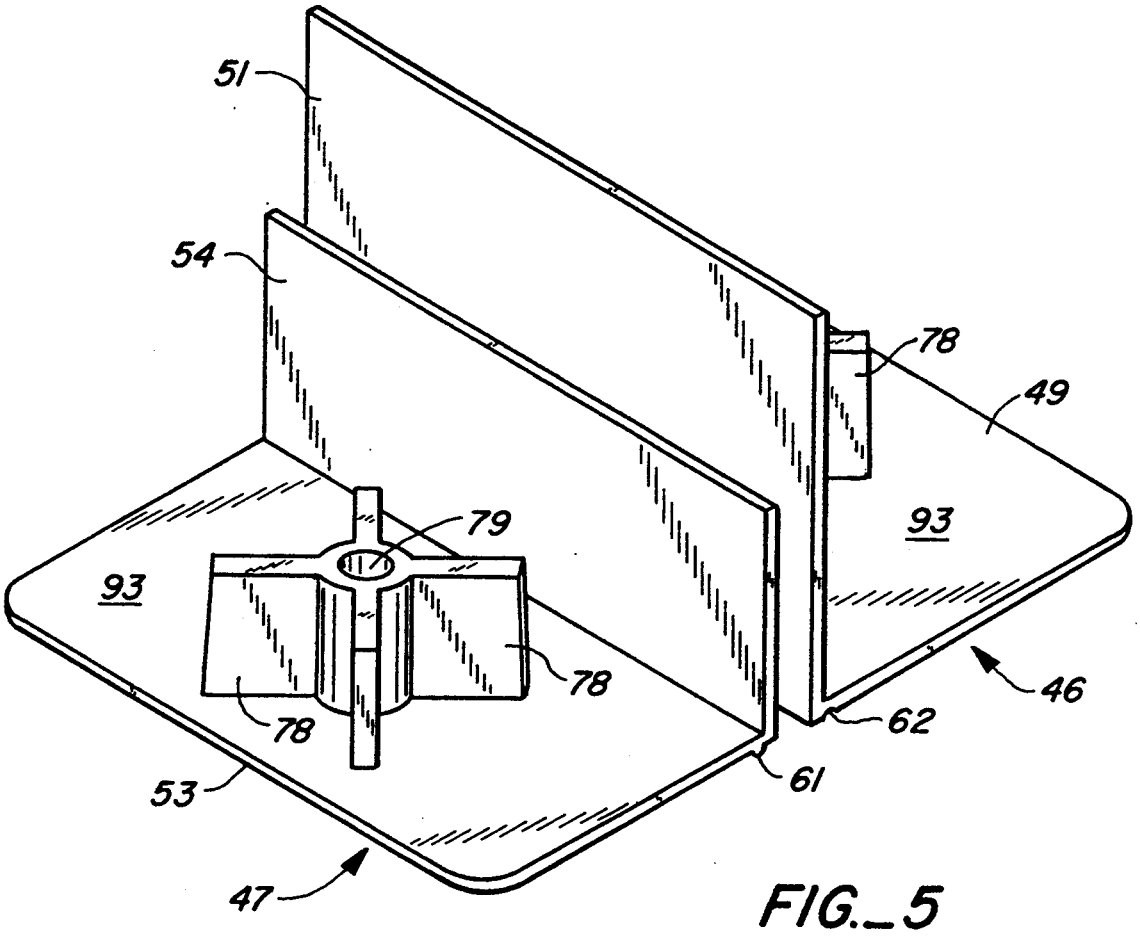
FIG. 5 is a top perspective view of the spacer assembly of FIG. 4.

FIGS. 4 and 5 illustrate door framing spacer 41 of the present invention with legs 51 and 54 rotated by 90 degrees about hinge means 48. In the position of FIGS. 4 and 5, it will be seen that spacer means 41 can be injection molded with parting lines along surfaces 93 of the legs 49 and 53. This allows one mold half to be pulled upwardly from surfaces 93, while the other mold half is pulled away in a downward direction.

Having described the spacer assembly of the present invention in detail, use of the same to install both a single and double door assemblies, as well as the method of the present invention, can be described.

For a single door, door jamb assembly 23 can be laid on a flat surface with door 21 hinged to jamb member 26 and the door propped open slightly relative to jamb member 27 so as to expose the edge of the door facing jamb 27. Spacer 41 can be mounted at lockset bore 72 and nailed or stapled to the exposed edge of the door. Similarly, a plurality of spacers constructed as shown for spacer 41*a* can be spaced along the edge of door 21 opposite jamb member 27, for example, as shown in FIG. 1. An additional spacer 41*a* can be positioned between jamb member 28 and the top edge of door 21. Each of spacers 41*a* are then nailed or stapled through legs 49 to the edge of the door so as to secure the spacers to the door.

Jamb element legs 53, 53*a* may be folded against door element leg 49, 49*a* and the door 21 closed, that is, positioned so that inner surface 96 of the door (FIG. 6)

bears against jamb trim member 97. Since the lower end 98 of jamb member 27 is not secured as yet, jamb member 27 can be displaced away from the edge of door 21 during the closing process to enable lockset alignment means 76 to be inserted into bore 73 in jamb member 27. Once inserted, lower end 98 of jamb member 27 can be brought up flush against legs 53 and 53*a* of the spacers. Jamb member 27 is then pressed against the combined legs 49 and 53, which automatically establish or set the reveal space. A second nail or fastener 42, 42*a* is driven through jamb element leg 54 or 54*a* and into the door jamb. This couples the door to the jamb member on the side of the door away from hinges 22. In order to further secure the assembly, tie means or strap 81 may be inserted through passageway 79 in the spacer and pulled down against one-way cinch 82 to even more positively secure the door and jamb assembly together.

With spacers 41, 41*a* mounted between door 21 and jamb assembly 23, the entire unit may be taken to door opening 31 and shimmed to a plumb condition in the opening with relative ease. Once properly shimmed, the jamb assembly may be nailed to the supporting door frame structure 32, and the spacers are now ready to be parted, severed or released.

Using a razor or knife, hinges 57 and 58 can be severed and tie 81, for example, by running the knife along seam 59 between the opposed edges of the door and jamb portions of the spacer. The detent groove 62 and protrusion 61 prevent-the door from swinging open, but one can easily reach through knob opening 71, grab the door and pull or push the door open by forcing the protrusion out of the recess. One or more of the spacers 41 and 41*a* may be left between the door and jamb as a temporary latch mechanism, and the remaining spacers may be removed by pulling fasteners 42, 42*a* and 43, 43*a*. It will be noted that after the spacer and tie have been removed, a trim member 98 (shown in phantom in FIG. 6) can be positioned and secured jamb 27 across the gap to sheetrock or wall member 33. Trim member 98, therefore, hides any nail or staple holes caused by fasteners 42 and 42*a*. The staple or nail holes caused by fasteners 43 and 43*a* are on the edge of the door and can be filled so as not to be unsightly.

The insulation process for the double or dutch door assembly of FIG. 1A is similar, except that spacers 41 and 41*a* are positioned between the two doors.

First, the double door and jamb assembly is laid flat on a support surface with the hinge side facing up. Existing shipping nails and spacers are removed and then the doors are propped up slightly so as to enable installation of spacer assemblies 41*a* at top 101 of both doors proximate the unhinged edges. The spacers are nailed by their door legs 49*a* to edges 101 of doors 21 and 21*a*. The hinge pins for door 21 are then removed and door 21 is folded to the position shown in FIG. 1A, namely, superimposed over second door 21*a*, which remains hinged to jamb 27. Spacers 41 and 41*a* are then inserted along the length of the two doors, as shown by arrows 102. Each of spacers 41 and 41*a* are oriented as shown in FIGS. 4 and 5, and the legs 51, 51*a* and 54, 54*a* are inserted between doors 21 and 21*a*. A nail or staple is now used to secure leg 49 to edge 103 of door 21 and a second nail is used to secure leg 53 to edge 104 of door 21*a*. Door 21 may now be swung about the hinged spacer members 41 and 41*a* until door edge 106 is next to jamb member 26. The hinge pins now may be installed in each of hinges 22 to secure the door 21 to jamb 26. This results in the legs 51, 51*a* and 54, 54*a* being exposed on the front of the door, and a second nail or fastener can be used to secure one of the two legs to the other door. In order to hide the nail holes, normally the leg which would be under a jamb trim piece mounted to one of the doors would be the leg which is nailed to the front of one of the doors. Finally, a tie or strap 81 can be mounted through the knob opening and lockset bores and cinched down to further secure the assembly together as a unit.

Spacer assemblies 41, 41*a*, therefore, tie edge 103 to edge 104, and the hinges 22 tie the opposite edges to jambs 26 and 27. The spacing of the upper edges 101 of the doors is secured also by spacer 41*a*, and the entire assembly can now be lifted up and installed, as a unit, in a door opening. Once plumbed and secured in the door opening, the tie and hinges can be severed, the doors opened, and the spacers removed, as above described.

What is claimed is:

1. A door framing device comprising:

spacer means formed for positioning of a portion thereof between a door and a member for spacing of said door in a door opening relative to said member during installation of said door;

fastener means for fastening said spacer to both said door and said member; and said spacer means further being formed with an L-shaped door element having one leg adapted to extend between said door and said member and another leg adapted to extend along a front surface of said door, said door element being formed for securement to said door by said fastener means; said spacer means including an L-shaped jamb element having one leg adapted to extend between said door and said member and another leg adapted to extend along a front surface of said member, said jamb element being formed for securement to said member by said fastener means; and said spacer means including a connecting portion separably connecting said door element to said jamb element to thereby releasably secure said door to said member during installation of said door in said door opening, and said one leg of said door element and said one leg of said jamb element having a combined thickness dimension substantially equal to a desired reveal space to be maintained between said door and said member.

2. The door framing device as defined in claim 1 wherein, said connecting portion is provided by severable hinge means extending between said another leg of said door element and said another leg of said jamb element.

3. The door framing device as defined in claim 1 wherein, said one leg of said door element has a thickness dimension which decreases in a direction away from said another leg of said door element; and said one leg of said jamb element has a thickness dimension which increase in a direction away from said another leg of said jamb element.

4. The door framing device as defined in claim 1 wherein, said one leg of said door element and said one leg of said jamb element have mating vertical registration surfaces.

5. The door framing device as defined in claim 4 wherein, said mating vertical registration surfaces are provided by a protrusion on said one leg of said door element and a recess on said one leg of said jamb element, said protrusion and said recess being V-shaped and converging in a direction toward said another leg of said door element and said another leg of said jamb element.

6. The door framing device as defined in claim 1 wherein, said one leg of said door element and said one leg of said jamb element each carry lockset opening registration means protruding therefrom in opposite directions.

7. The door framing device as defined in claim 6 wherein, said member is a jamb member, and said lockset opening registration means on each of said door element and said jamb element includes passageway extending through said door element and a passageway extending through said jamb element, and each lockset opening registration means further includes radially extending vane means formed for engagement with said door and said jamb member in an area thereof defining a an opening in said door and an opening in said jamb member formed to receive a lockset.

8. The door framing device as defined in claim 7, wherein said door framing device further includes, tie strap means formed for mounting through said passageway means and around said door and said jamb member in said lockset opening in said door and in said jamb member.

9. The door framing device as defined in claim 8 wherein, said tie strap means includes a one-way cinching means and said tie strap means is formed from a plastic material.

10. The door framing device as defined in claim 1, wherein said door framing device further includes, tie means formed for encircling a portion of said door and a portion of said member, and formed for tying said door and said member together as a unit with said spacer means therebetween.

11. The door framing device as defined in claim 10 wherein, said tie means is formed of a severable material and includes a portion positioned for severing from an exterior side of said door after installation thereof.

12. The door framing device as defined in claim 1 wherein, said another leg of said jamb element includes alignment means extending transversely from said member by a distance sufficient for aligning said member with a front surface of a structural element defining said door opening.

13. The door assembly as defined in claim 1 wherein, said spacer means includes protrusion means protruding between said door element and said jamb element to provide a detent releasably resisting opening of said door after severing of said connecting portion.

14. A pre-hung door assembly comprising:

a door jamb assembly having a door opening;

a first door positioned inside said jamb assembly and having one side and an oppositely facing side;

hinge means mounting said one side of said first door to a first jamb member of said door jamb assembly;

spacer means positioned between said oppositely facing side of said first door and a door opening defining member, said spacer means having a thickness dimension spacing said first door and said door opening defining member by a desired distance; said spacer means formed as one piece and having a door portion and a jamb portion connected to said door portion and formed for separation from said door portion from an exterior side of said door assembly after installation of said door assembly in said door opening; and fastener means securing said door portion to said first door and securing said jamb portion to said door opening defining member to thereby couple said first door to said door opening defining member.

15. The pre-hung door assembly as defined in claim 14 wherein, said door opening defining member is provided by a second door positioned inside said jamb assembly, said second door being hinged at one side by hinge means to a second jamb member, and said spacer means is positioned between said first door and said second door.

16. The pre-hung door assembly as defined in claim 14 wherein, said spacer means is formed of a plastic material and includes a connecting hinge portion between said door portion and said jamb portion positioned for severing from an exterior side of said door assembly after installation of said door assembly in said door opening.

17. A method of installing a pre-hung door assembly and jamb assembly in a door opening comprising the steps of:

positioning a door assembly including two doors and a jamb assembly in a door opening with a spacer means mounted between said two doors, each of said two doors being hinged to said jamb assembly along a side thereof opposite said spacer means, said spacer means having a thickness dimension equal to a desired reveal space and being secured to both of said two doors to couple said two doors together for handling during said positioning step, securing said door assembly and said jamb assembly in said door opening; and thereafter, from one side of said door assembly and said jamb assembly, releasing said spacer means for opening of said two doors.

18. A method of installing a pre-hung door assembly in a door opening comprising the steps of:

positioning a pair of doors and a jamb assembly in a door opening with a spacer mounted between said pair of doors having a thickness dimension equal to a desired space between said pair of doors, said spacer having one element secured to one of said pair of doors, another element secured to a remainder of said pair of doors, and a severable connecting portion coupling said one element to said another element to couple said pair of doors together as a unit for handling during said positioning step;

securing said pair of doors and said jamb assembly in said door opening; and thereafter, severing said connecting portion or said spacer from one side of said pair of doors and said jamb assembly to release said one element from said another element for opening of said pair of doors.

19. A pre-hung door assembly comprising:

a door jamb assembly;

a first door positioned inside said jamb assembly and having one side and an oppositely facing side;

hinge means mounting said one side of said first door to a first jamb member of said door jamb assembly;

a plurality of spacer means positioned between said oppositely facing side of said first door and a door opening defining member, said spacer means each having a thickness dimension spacing said first door and said door opening defining member by a desired distance; said spacer means each formed as one piece and having a door portion and a jamb portion connected to said door portion and formed for separation from said door portion from an exterior side of said door assembly after installation of said door assembly in a door opening; and fastener means securing said door portion to said first door and additional fastener means securing said jamb portion to said door opening defining member to thereby couple said first door to said door opening defining member.

20. The pre-hung door assembly as defined in claim 19 wherein, at least one of said spacer means is mounted between an upper edge of said first door and a door jamb member positioned above said door assembly.

* * * * *